US011786032B2

(12) United States Patent
Butcher

(10) Patent No.: US 11,786,032 B2
(45) Date of Patent: Oct. 17, 2023

(54) MASCARA APPLICATOR SYSTEM WITH PIVOTING OFFSET BRUSH HEAD

(71) Applicant: John Butcher, Yardley, PA (US)

(72) Inventor: John Butcher, Yardley, PA (US)

( * ) Notice: Subject to any disclaimer, the term of this patent is extended or adjusted under 35 U.S.C. 154(b) by 107 days.

(21) Appl. No.: 17/524,712

(22) Filed: Nov. 11, 2021

(65) Prior Publication Data

US 2023/0141613 A1 May 11, 2023

(51) Int. Cl.

| | |
|---|---|
| ***A45D 40/26*** | (2006.01) |
| ***A46B 5/00*** | (2006.01) |
| ***A46B 9/02*** | (2006.01) |

(52) U.S. Cl.

CPC ..... *A46B 5/0037* (2013.01); *A45D 40/265* (2013.01); *A46B 9/021* (2013.01); *A46B 2200/1053* (2013.01)

(58) Field of Classification Search

CPC .. A45D 40/262; A45D 40/264; A45D 40/265; A45D 2200/10; A46B 5/0037; A46B 9/021; A46B 2200/1053

See application file for complete search history.

(56) References Cited

U.S. PATENT DOCUMENTS

| | | | |
|---|---|---|---|
| 3,921,650 | A | 11/1975 | Montgomery |
| 4,165,755 | A | 8/1979 | Cassai |
| 4,222,677 | A | 9/1980 | Cervantes |
| 4,428,388 | A | 1/1984 | Cassai et al. |
| 4,600,328 | A | 7/1986 | Clements |
| 5,611,361 | A | 3/1997 | Leone |
| 6,050,273 | A | 4/2000 | Lhuisset |
| 6,581,610 | B1 | 6/2003 | Gueret |
| 6,718,990 | B1 | 4/2004 | Chastain et al. |
| D509,414 | S | 9/2005 | Hinden |
| 7,465,114 | B2 | 12/2008 | Kress et al. |
| 7,762,269 | B2 | 7/2010 | Wyatt et al. |
| 9,339,098 | B2 | 5/2016 | Takata et al. |
| 10,463,142 | B2 | 11/2019 | Borsari |
| 2008/0283083 | A1 | 11/2008 | Piao |
| 2011/0174328 | A1 | 7/2011 | Cerutti et al. |
| 2014/0109928 | A1 | 4/2014 | Simard |

(Continued)

FOREIGN PATENT DOCUMENTS

| | | | |
|---|---|---|---|
| DE | 199 00 784 | 7/2000 | |
| EP | 2974618 A1 * | 1/2016 | ..... A45D 34/045 |

(Continued)

*Primary Examiner* — Rachel R Steitz

(74) *Attorney, Agent, or Firm* — LaMorte & Associates, P.C.

(57) ABSTRACT

A system for the application of mascara. The system has a container and an applicator wand. The applicator wand has a handle that extends along a central axis. A wand shaft extends from the handle and hold a brush head. The brush head includes a brush held in an articulable mount. The articulable mount orients the brush in a position where the central axis of the handle intersects the center line of the brush at a point between the ends of the brush. The brush is biased to a first angle of inclination. The articulable mount provides a hinge joint between the brush and the wand shaft. The hinge joint enables the brush to temporarily rotate about the hinge joint away from its first angle of inclination and into a second angle of inclination to pass into or out of the access opening of the container.

16 Claims, 9 Drawing Sheets

(56) References Cited

U.S. PATENT DOCUMENTS

| | | | | |
|---|---|---|---|---|
| 2016/0015151 | A1 | 1/2016 | Balestrini | |
| 2017/0360179 | A1 | 12/2017 | Manici et al. | |
| 2020/0046108 | A1 | 2/2020 | Bellah | |
| 2021/0307489 | A1 * | 10/2021 | Butcher | A45D 40/267 |

FOREIGN PATENT DOCUMENTS

| | | |
|---|---|---|
| FR | 3 042 391 | 4/2017 |
| JP | 4 254 523 B2 | 4/2009 |
| WO | WO 2018/051219 A1 | 3/2018 |

* cited by examiner

MASCARA APPLICATOR SYSTEM WITH PIVOTING OFFSET BRUSH HEAD

BACKGROUND OF THE INVENTION

1. Field of the Invention

In general, the present invention relates to mascara systems and the structure of applicator wands and brush heads used in mascara systems. More particularly, the present invention relates to the structure of the applicator wand, the brush head, and features within a mascara container that have an effect on the applicator wand and brush head.

2. Prior Art Description

Most people have a dominant hand. That is, most people are either left-handed or right-handed. In human biology, a person tends to use their dominant hand more often than their non-dominant hand. Furthermore, the dominant hand is typically used to perform precise movements, such as those used when writing or drawing. Consequently, a person tends to have far better hand-eye coordination with their dominant hand than with their non-dominant hand.

When a person applies makeup to their own face, it often requires the use of fine motor skills. Accordingly, a person generally uses their dominant hand when applying makeup to the face. However, depending upon the makeup being applied, it is often not possible for a dominant hand to be used, or if the dominant hand is used, the dominant hand is manipulated in an unnatural way, therein causing inferior results. For instance, mascara is a cosmetic that is typically applied to the eyelashes. The mascara is used to darken, thicken, lengthen, and/or otherwise define the eyelashes. Typically, mascara is in liquid form, contained in a vial and is applied to the eyelashes using a small brush head at the end of an applicator wand. If a person is right-handed, they typically grasp the applicator wand with their right hand and apply the mascara to the eyelashes of the right eye with ease. This is typically done in front of a mirror. When the person attempts to use their right hand to apply mascara to their left eye, the applicator wand is held at a compromised angle as it approaches the left eye. This orientation makes it difficult to access the lashes close to the bridge of the nose with the narrow end of the brush head. This compromised angle also negates any benefits of a brush head design and produces inferior results, as compared to the results realized with the right eye. Another option is to have a person reverse their grip and approach the left eye from the left side. However, since the person is using their non-dominant hand, precision is lost and mistakes are commonly made. Accordingly, inferior results are produced and more clean-up is required after application.

In the prior art, certain makeup applicator wands are designed to be used by the left hand and/or the right hand. When the applicator wand is changed between hands, the applicator wand must be inverted or the brush head changed. Such prior art is exemplified by U.S. Pat. No. 4,165,755 to Cassai and U.S. Pat. No. 6,718,900 to Chastain. Also, in the prior art, applicator wands have been designed that enable the applicator wands to be used with either the right hand or the left hand without the need for inversion. Some of these prior art applicators use a hinge that connects the brush head to the wand shaft. The hinge is located on the wand shaft near the brush head so that the angle of the brush head can be altered relative to the wand shaft. Such prior art applicator wands are exemplified by U.S. Pat. No. 4,165,755 to Cassai, U.S. Patent Application No. 2014/0109928 to Simard, and U.S. Patent Application No. 2011/0174328 to Cerutti. A major problem with such hinged applicator wands is that the brush head must be manually bent to an angle relative the wand shaft that is useful for applying makeup. The brush head and wand shaft must then be straightened so they can pass back into the mascara container. When applying mascara, the brush head and wand shaft may be inserted into and removed from the mascara container several times. This means that the brush head must be engaged and the hinge joint bent and straightened multiple times. A person does not want to touch the brush head, since it is coated with mascara. As such, it is not unusual for a user to bend the hinge by positioning the brush head in the neck of the mascara container and applying a bending torque to the wand shaft. This inevitably contaminates the exterior of the neck with splashes of mascara. This overflow of mascara is then contacted when a person holds the mascara container or attempts to cap or uncap the mascara container.

A need therefore exists for an improved mascara applicator system that enables a person to automatically tilt the mascara brush head in relation to the wand shaft without having to touch the brush head and without effecting the ability of the applicator brush to pass into or out of a mascara container. This need is met by the present invention as described and claimed below.

SUMMARY OF THE INVENTION

The present invention is a system for the application of mascara. The system uses a container of mascara. The mascara is drawn from the container using an applicator wand and a brush head. The applicator wand has a handle that extends along a central axis. A wand shaft extends from the handle. At the opposite side of the wand shaft is a brush head that holds a brush. The brush head has a first end and an opposite second end. The brush has bristles that are disposed about a center line. The brush is supported by an articulable mount. The articulable mount is coupled to both the brush and the wand shaft. The articulable mount orients the brush in a position where the central axis of the handle intersects the center line of the brush at a point between the first end and the second end of the brush.

The brush follows a center line. The center line of the brush is biased to a first angle of inclination, relative to the central axis of the handle, by the articulable mount. The articulable mount provides a hinge joint between the brush and the wand shaft. The hinge joint enables the brush to temporarily rotate about the hinge joint away from its first angle of inclination and into a second angle of inclination. In the second angle of inclination, the brush and articulable mount are narrow enough to pass into or out of the access opening of the container.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention mascara applicator system can be embodied in many ways, only two exemplary embodiments are illustrated. The exemplary embodiments are being shown for the purposes of explanation and description. The exemplary embodiments are selected in order to set forth two of the best modes contemplated for the invention. The illustrated embodiments, however, are merely exemplary and should not be considered limitations when interpreting the scope of the appended claims.

Figure 1:
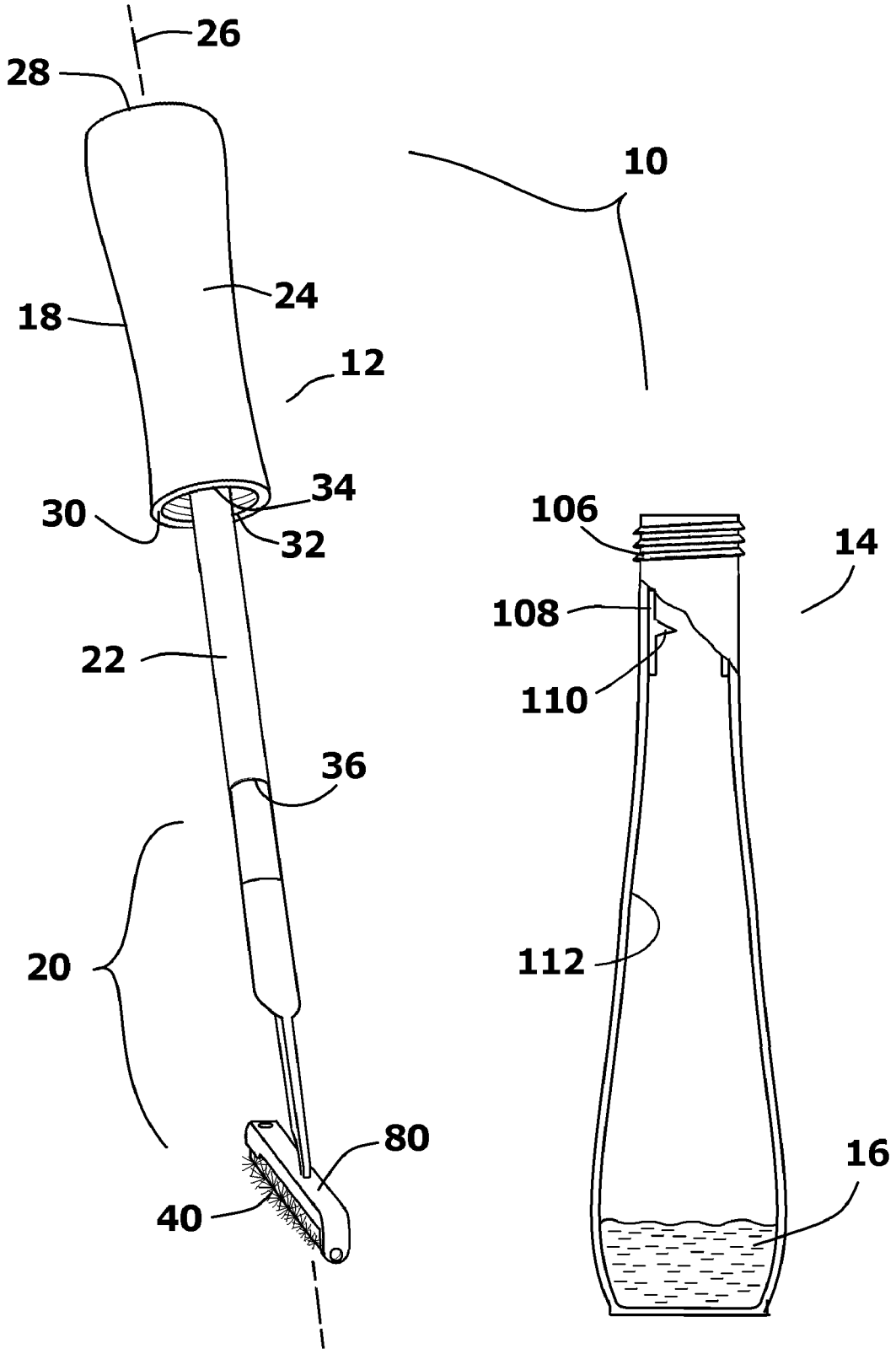
FIG. 1 is a partially fragmented view of a first exemplary embodiment of a mascara application system having an applicator and a container that are disconnected.

Referring to FIG. 1, a mascara application system 10 is shown. The mascara application system 10 consists of an applicator wand 12 and a container 14. The container 14 holds a volume of mascara 16. The applicator wand 12 has a brush head 20 at its distal end. The applicator wand 12 and brush head 20 are used to remove some of the mascara 16 from the container 14 and apply the mascara 16 to the eyelashes of a user.

The applicator wand 12 has a handle 18 and a wand shaft 22 that extends from the handle 18. The wand shaft 22 connects the brush head 20 to the handle 18. The handle 18 serves two purposes. The handle 18 has a contoured exterior surface 24 that is used to comfortably grip the handle 18. The handle 18 also serves as a cap to the container 14 that holds the mascara 16. The handle 18 is symmetrically formed about a central axis 26 and has a first end 28 and an opposite second end 30. A cap depression 32 is formed in the first end 28. The cap depression 32 is symmetrically formed about the central axis 26 and is threaded so it can be tightened onto the container 14.

The wand shaft 22 extends into the handle 18 through the center of the cap depression 32. The wand shaft 22 is preferably straight and shares the same central axis 26 as does the handle 18. The wand shaft 22 extends between a first end 34 and a second end 36. The first end 34 of the wand shaft 22 is anchored within the handle 18. This causes the wand shaft 22 to extend from the handle 18 as a cantilever. The second end 36 of the wand shaft 22 supports the brush head 20.

Figure 2:
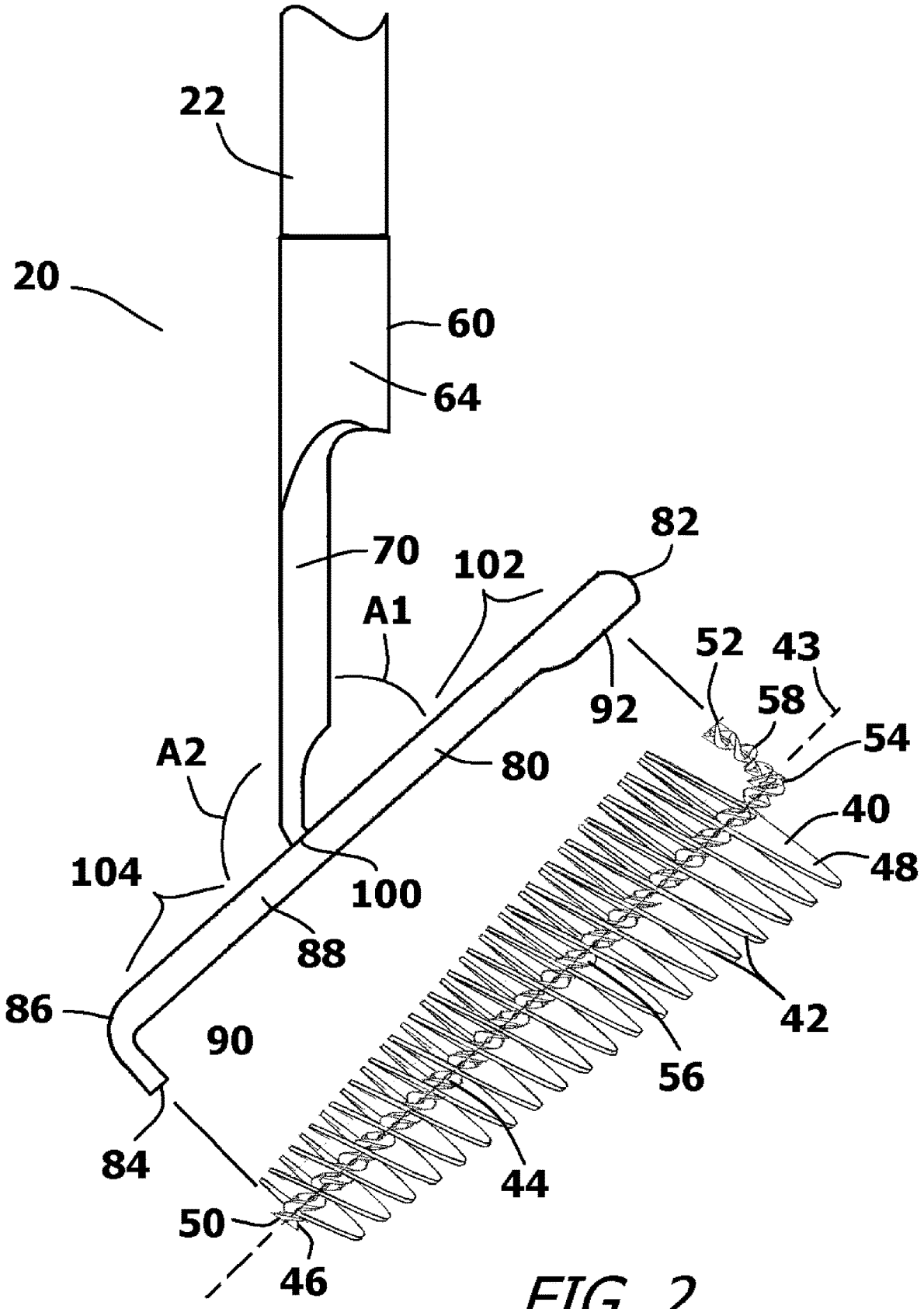
FIG. 2 is an enlarged side view of the brush head at the end of the applicator used in the first exemplary embodiment.
Figure 3:
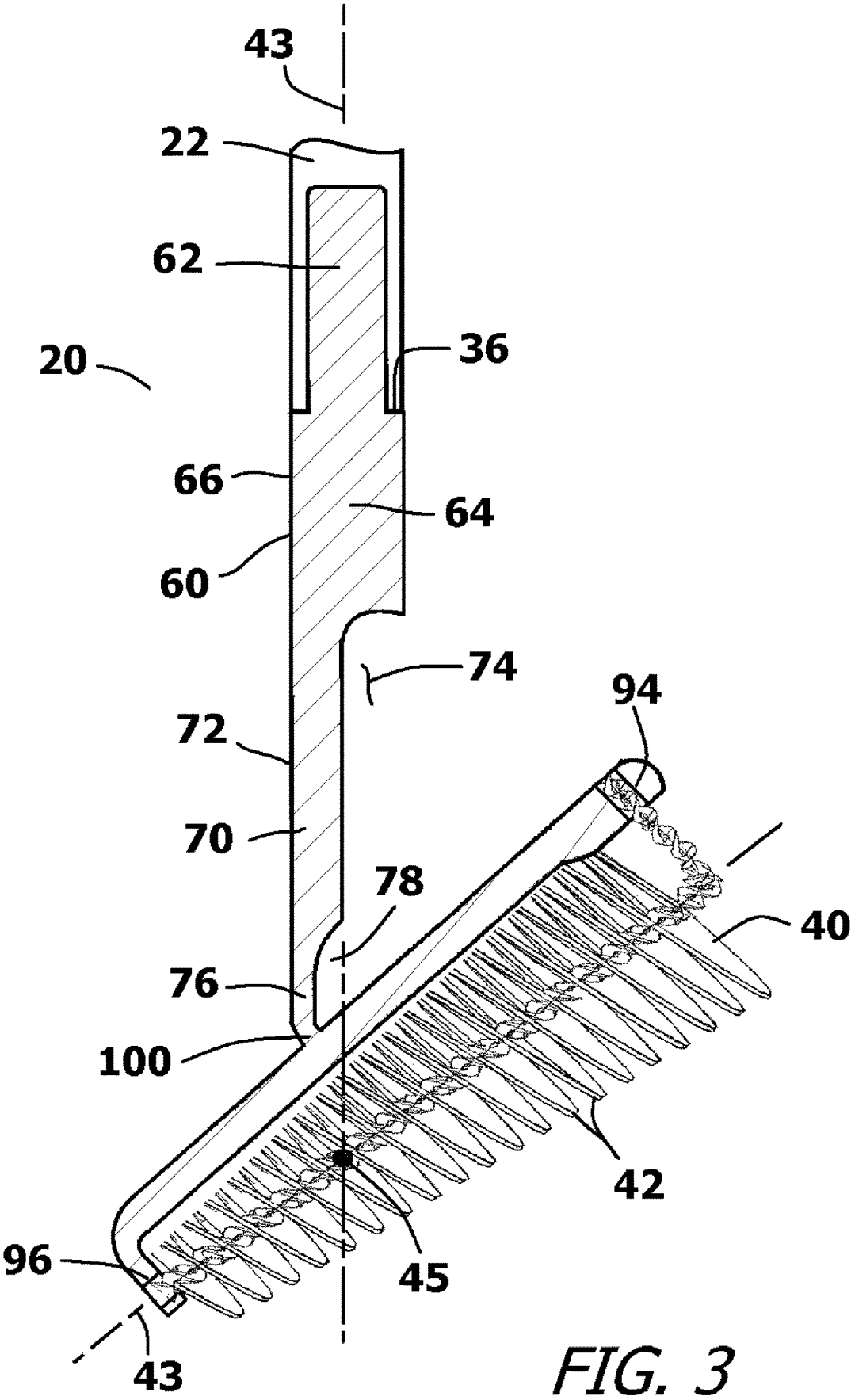
FIG. 3 is a cross-sectional view of the enlarged side view shown in FIG. 2.

Referring to FIG. 2 and FIG. 3 in conjunction with FIG. 1, it can be seen that the structure of the brush head 20 is unique. The brush head 20 has a brush 40. The brush 40, as illustrated, is a twist wire brush with bristles 42 are set into a length of twisted wire 44. It should be understood that a molded brush with molded bristles can be substituted for the wire brush shown, as is later shown. However, in the embodiment of FIG. 2 and FIG. 3, the bristles 42 are formed around a common center line 43. The brush 40 presents with a cone shape. Accordingly, the brush 40 has a small diameter end 46 and a large diameter end 48. The twisted wire 44 has a first end 50, an opposite second end 52, and a bend 54 near the second end 52. The twisted wire 44 has a straight section 56 between the first end 50 and the bend 54. The straight section 56 of the twisted wire 44 follows the center line 43 and contains the bristles 42. At the bend 54, the twisted wire 44 is bent at a right angle to produce a dog-leg configuration 58 near the second end 52.

An articulable mount 60 is provided. The articulable mount 60 connects the brush 40 to the wand shaft 22. The articulable mount 60 has a peg end 62 that is used to interconnect with the wand shaft 22. The peg end 62 can be tubular and can receive the second end 36 of the wand shaft 22. Alternatively, if the wand shaft 22 is tubular, the peg end 62 can have a small diameter that passes into the second end 36 of the wand shaft 22. In either construction, the peg end 62 mechanically interconnects the articulable mount 60 to the second end 36 of the wand shaft 22.

Within the structure of the articulable mount 60, the peg end 62 extends from a base 64. The base 64 is cylindrical in shape and has an exterior surface 66. A flexible arm 70 extends from the base 64, on the side opposite the peg end 62. The flexible arm 70 extends in parallel to the wand shaft 22. The flexible arm 70 is thinner than the base 64. The flexible arm 70 has a long side edge 72 that aligns flush with the exterior surface 66 of the base 64. Since the flexible arm 70 is thinner than the base 64, an open area 74 is disposed next to the flexible arm 70 that is within the profile shadow of the base 64. In addition, the flexible arm 70 has a distal end 76 that is farthest from the base 64. The flexible arm 70 thins near the distal end 76, therein forming a relief 78 in the flexible arm 70 near the distal end 76. The purpose of the open area 74 and the relief 78 are later described.

A support bracket 80 is provided that holds the brush 40. The support bracket 80 has a first end 82, an opposite second end 84, and a bend 86 near the second end 84. In the illustrated embodiment, the support bracket 80 is generally L-shaped, wherein the support bracket 80 has a long straight section 88 between the first end 82 and the bend 86, and a short section 90 between the bend 86 and the second end 84. A thickened pad 92 is formed near the first end 82. A first mounting hole 94 is formed in the thickened pad 92 near the first end 82. A second mounting hole 96 is formed in the support bracket 80 between the bend 86 and the second end 84.

The distal end 76 of the flexible arm 70 engages the support bracket 80 at a hinge joint 100. The hinge joint 100 can be a traditional pin hinge. However, in the preferred embodiment that is illustrated, the flexible arm 70 and the support bracket 80 are unistructally molded together, therein forming a hinge joint that is a living hinge, that is, a natural bending point in the molded plastic.

The long straight section 88 of the support bracket 80 has a first part 102 and a second part 104 on opposite sides of the hinge joint 100. The first part 102 is longer than the second part 104. Preferably, the first part 102 is at least 1.5 times longer than the second part 104. When unstressed, the first part 102 is biased into an acute angle A1 with the flexible arm 70. The acute angle A1 is preferably between forty degrees and fifty-five degrees. The second part 104 creates a complementary obtuse angle A2 with the flexible arm 70. As such, the complementary obtuse angle A2 is preferably between 150 degrees and 135 degrees. Both the acute angle A1 and the complementary obtuse angle A2 will change as the support bracket 80 rotates about the hinge joint 100.

The support bracket 80 holds the brush 40. The twisted wire 44 extends through the brush 40. The first end 50 of the twisted wire 44 is received in the second mounting hole 96 near the second end 84 of the support bracket 80. The second end 52 of the twisted wire 44 is received in the first mounting hole 94 near the first end 82 of the support bracket 80. The straight section 56 of the brush 40 is held parallel to the long straight section 88 of the support bracket 80. Accordingly, when the angle of inclination of the support bracket 80 changes relative to the flexible arm 70, the angle of inclination for the brush 40 also changes.

The brush 40 is biased into a first angle of inclination shown in FIG. 2 and FIG. 3, by the molded shape of the articulable mount 60. In this first angle of inclination, the central axis 26 of the handle 18 intersects the center line 43 of the brush 40 at an intersection point 45. This first angle of inclination of the brush 40 creates a complex shape that would be very difficult to insert into, or draw from, a mascara container with a narrow neck.

Figure 4:
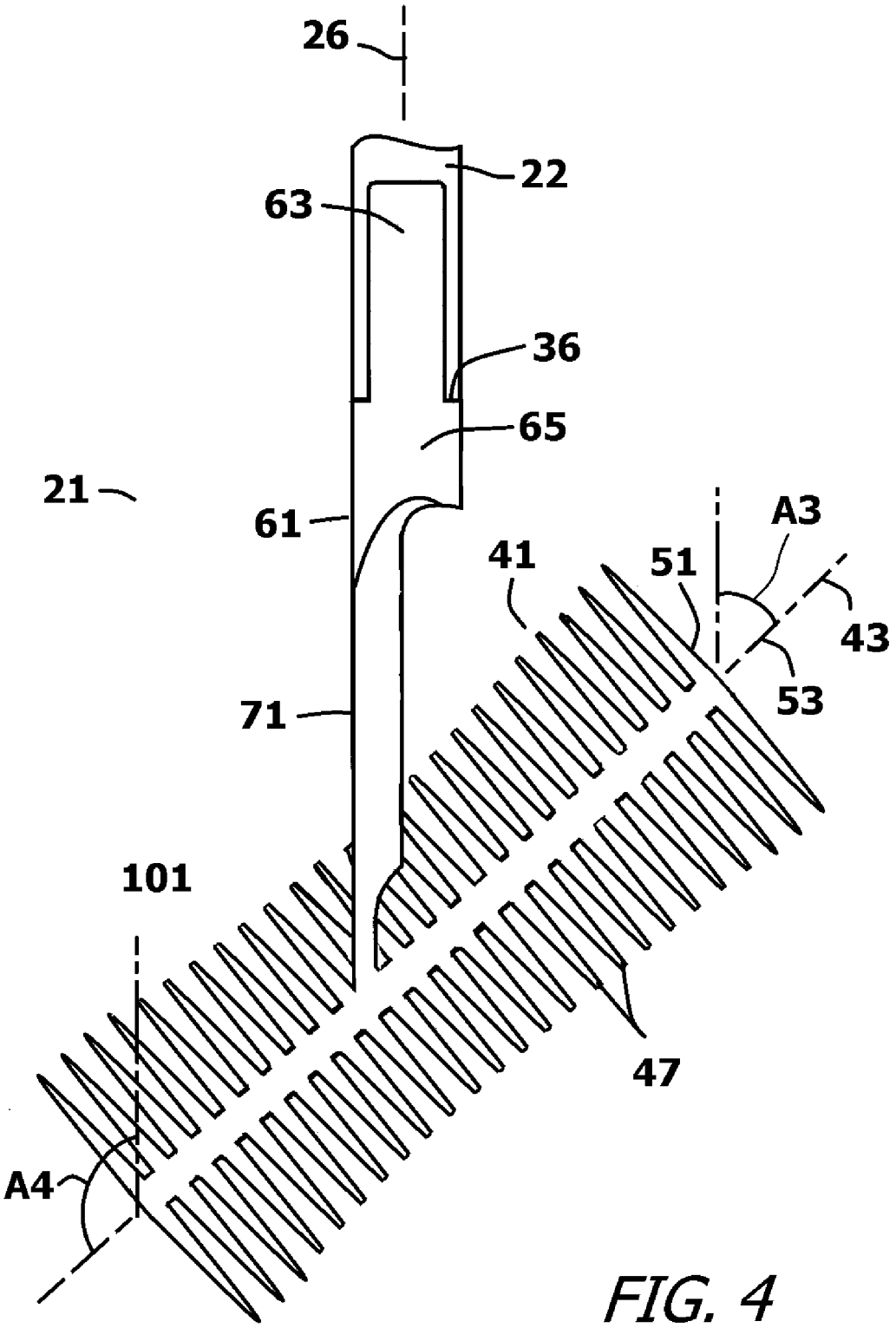
FIG. 4 is a cross-sectional view of a second exemplary embodiment for the brush head at the end of the applicator.

Referring to FIG. 4, an alternate embodiment for the brush head 21 is illustrated. The brush head 21 has a molded brush 41. The molded brush 41, as illustrated, has molded bristles 47 that extend from a common center line 45. The brush 41 has a first end 51, an opposite second end 53. An articulable mount 61 is provided. The articulable mount 61 connects the brush 41 to the wand shaft 22. The articulable mount 61 has a peg end 63 that is used to interconnect with the wand shaft 22. The peg end 63 can be tubular and can receive the second end 36 of the wand shaft 22. Alternatively, if the wand shaft 22 is tubular, the peg end 63 can have a small diameter that passes into the second end 36 of the wand shaft 22. In either construction, the peg end 63 mechanically interconnects the articulable mount 61 to the second end 36 of the wand shaft 22.

Within the structure of the articulable mount 61, the peg end 63 extends from a base 65. A flexible arm 71 extends from the base 64. The flexible arm 71 can have a slight curve be is shown as being straight. The flexible arm 71 extends to the midline 45 of the molded brush 41. It will be understood that the molded brush 41, the flexible arm 71, the base 65 and the peg end 63 can all be molded together as a single unit. A hinge joint 101 is formed where the flexible arm 71 intersects the molded brush 41. The hinge joint 101 is a living hinge, that is, a natural bending point in the molded plastic.

When unstressed, the molded brush 41 is biased into an acute angle A3 and a complementary obtuse angle A4 with the flexible arm 71. The acute angle A3 is preferably between forty degrees and fifty-five degrees. The complementary obtuse angle A4 is preferably between 150 degrees and 135 degrees. Both the acute angle A3 and the complementary obtuse angle A4 will change as the molded brush 41 rotates about the hinge joint 101.

Figure 5:
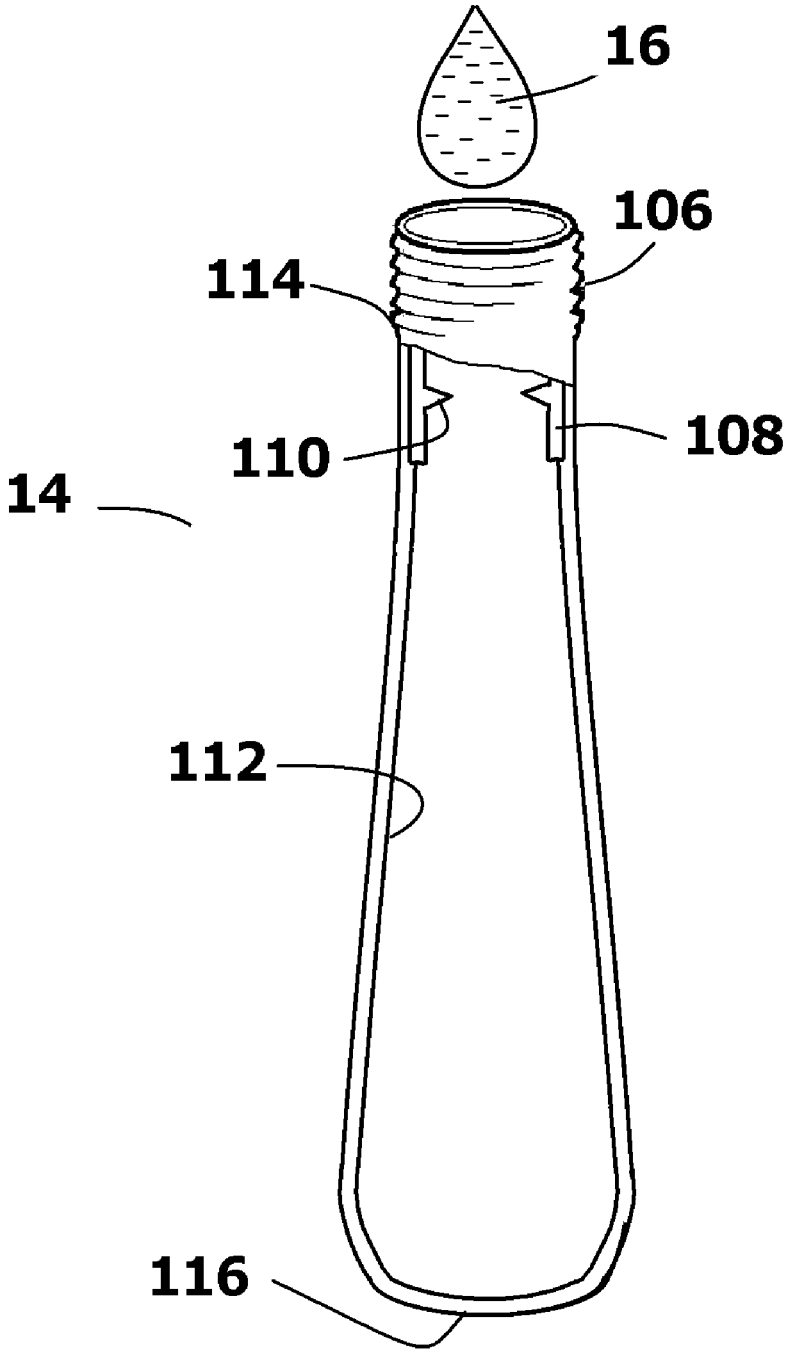
FIG. 5 is an enlarged cross-sectional view of the mascara container shown in FIG. 1.

Referring to FIG. 5 in conjunction with FIG. 1, it can be seen that the internal structure of the container 14 has been redesigned to work with the improved brush heads described in either FIG. 3 or FIG. 4. For the purposes of description, the functionality of the container 14 is described below as interacting with the brush head constructs of FIG. 3. However, the container 14 interacts with the molded head of FIG. 4 in the same manner.

The container 14 has a threaded neck 106 that is sized to engage the cap depression 32 in the handle 18. Within the container 14, a wiper insert 108 is set in, the threaded neck 106. The wiper insert 108 removes excess mascara 16 from the brush head 20 as the brush head 20 is retracted out of the container 14. The wiper insert 108 has an annular wiper 110. Both the inner diameter of the threaded neck 106 and the diameter of the annular wiper 110 are smaller than the length of the support bracket 80 and the brush 40 it holds. As a result, it will be understood that the support bracket 80 must be momentarily deflected away from its natural first angle of inclination in order to pass into, and out of, the container 14. To facilitate this deflection, the interior surfaces 112 of container is shaped into a funnel guide. The funnel guide 112 can be an insert that is added into the container 14. However, it is preferred that the interior surfaces 112 serve as the funnel guide. The container 14 has a tapered shape with a narrow end 114, a wide end 116, and an expanding funnel shape that leads from the narrow end 114 to the wide end 116.

Figure 6:
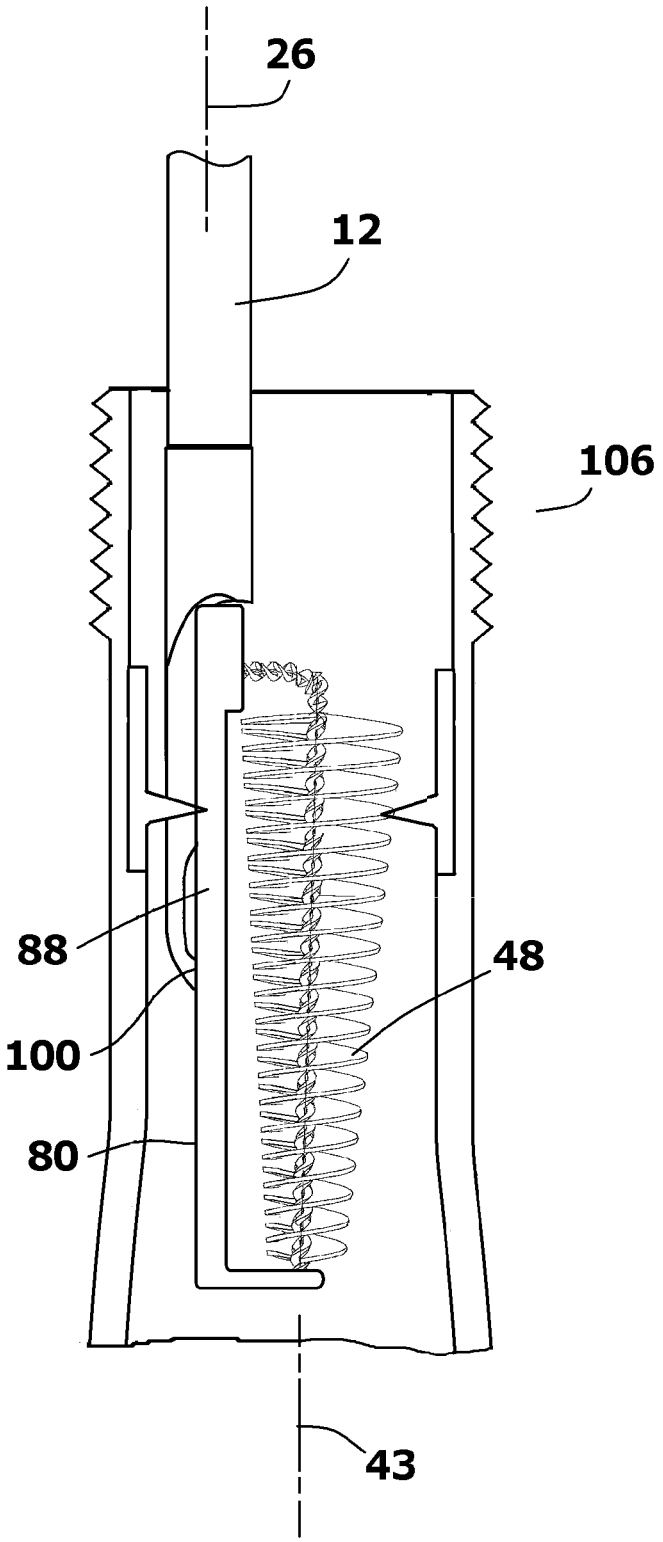
FIG. 6 is a fragmented cross-sectional view of the mascara container of FIG. 5 receiving the first exemplary embodiment of the brush head.

Referring to FIG. 6, in conjunction with FIG. 1 and FIG. 4, in conjunction with FIG. 3, it can be seen that when the applicator wand 12 is inserted into the threaded neck 106 of the container 14, the support bracket 80 and the brush 40 rotate about the hinge joint 100 to a second angle of inclination. In the second angle of inclination, the center line 43 of the brush 40 is oriented in parallel with the central axis 26 of the handle 18. When in the second angle of inclination, the long straight section 88 of the support bracket 80 rotates into the open area 74 alongside the flexible arm 70. The relief 78 in the flexible arm 70 prevents the flexible arm 70 from interfering with the support bracket 80 when in the parallel orientation.

Figure 7:
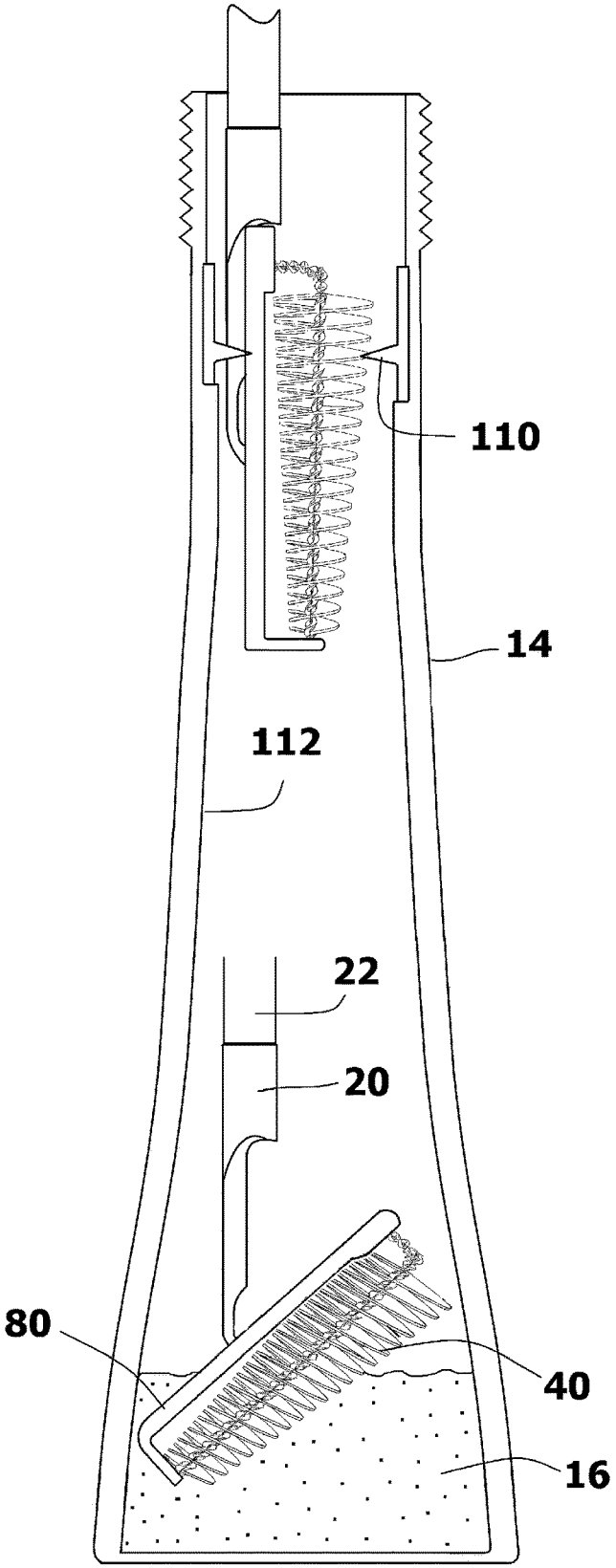
FIG. 7 is a fragmented cross-sectional view of the mascara container having received the first exemplary embodiment of the brush head.

Referring to FIG. 7, it can be seen that when the wand shaft 22 and brush head 20 are fully inserted into the container 14, the support bracket 80 and the brush 40 return to their natural angle of inclination. In this inclination, the brush 40 contacts and retains some of the mascara 16. As the brush head 20 is retracted out of the container 14 for use, the support bracket 80 gradually contacts the narrowing interior surfaces 112. The taper of the interior surfaces 112 deflects the support bracket 80 and the brush 40 into the configuration shown in FIG. 6. That is, the support bracket 80 and the brush 40 are parallel to the wand shaft 22. The support bracket 80 and the brush 40 can then pass through the annular wiper 110, wherein excess mascara 16 is wiped from the brush 40.

Figure 8:
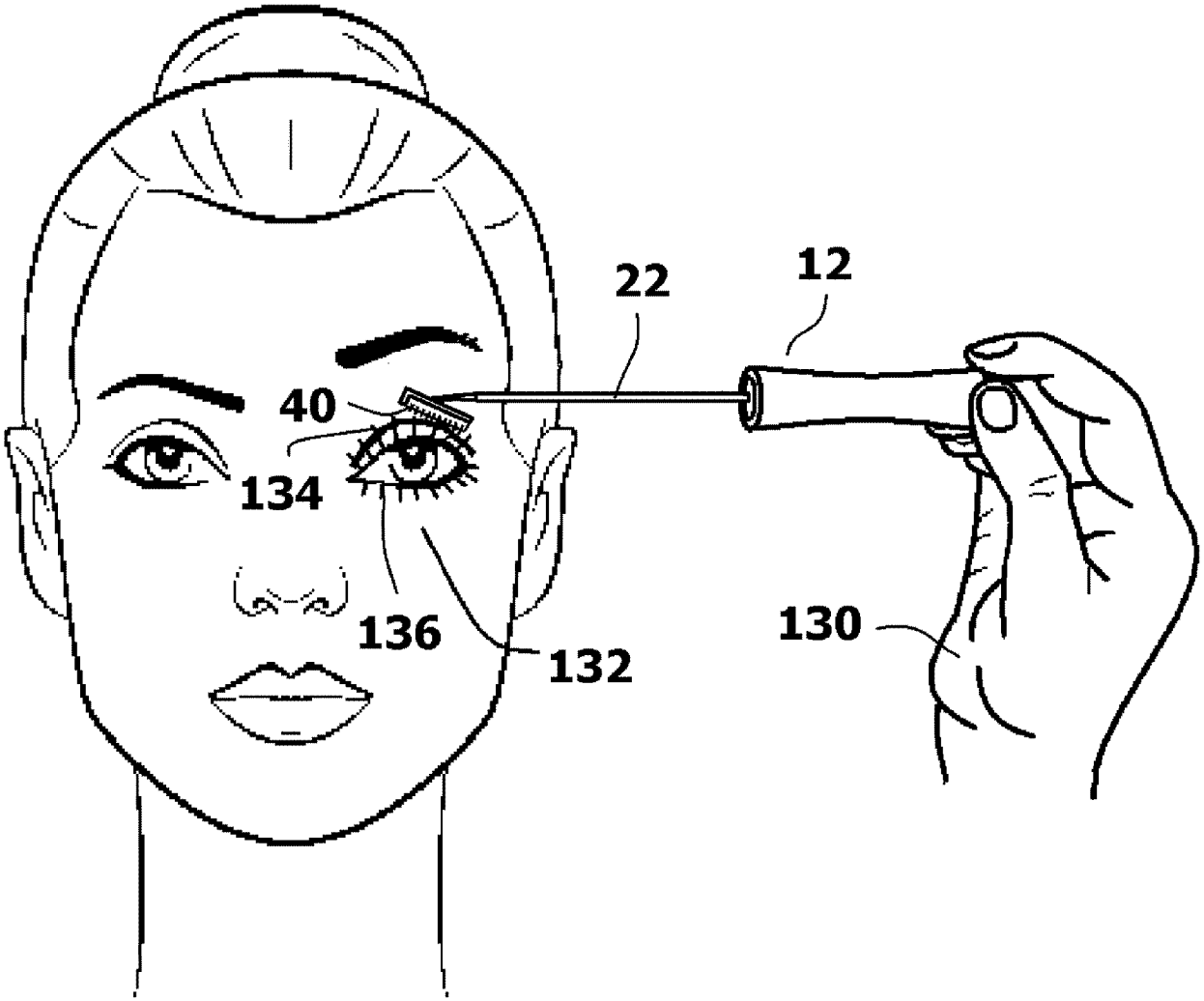
FIG. 8 shows the applicator of the exemplary embodiment of FIG. 1 in conjunction with a face and a dominant hand, wherein mascara is being applied to a first eye.

Referring to FIG. 8 in conjunction with FIG. 1 and FIG. 2, it can be seen that the applicator wand 12 is drawn from the container 14 and is held in a user's dominant hand 130. The dominant hand 130 is then used to apply mascara 16 to a first eye 132 that is closest to the dominant hand 130. The brush 40 is oriented at an angle relative to the wand shaft 22. The wand shaft 22 extends from a point near the center of the brush 40. As such, the wand shaft 22 does not interfere with either end of the brush 40. As such, either the small diameter end 46 of the brush 40 or the large diameter end 48 of the brush 40 can easily be oriented near the corner of the eye closest the nose. In addition, the brush 40 can easily be brought into full contact with either the upper lashes 134 or the lower lashes 136 surrounding the eye 132.

Figure 9:
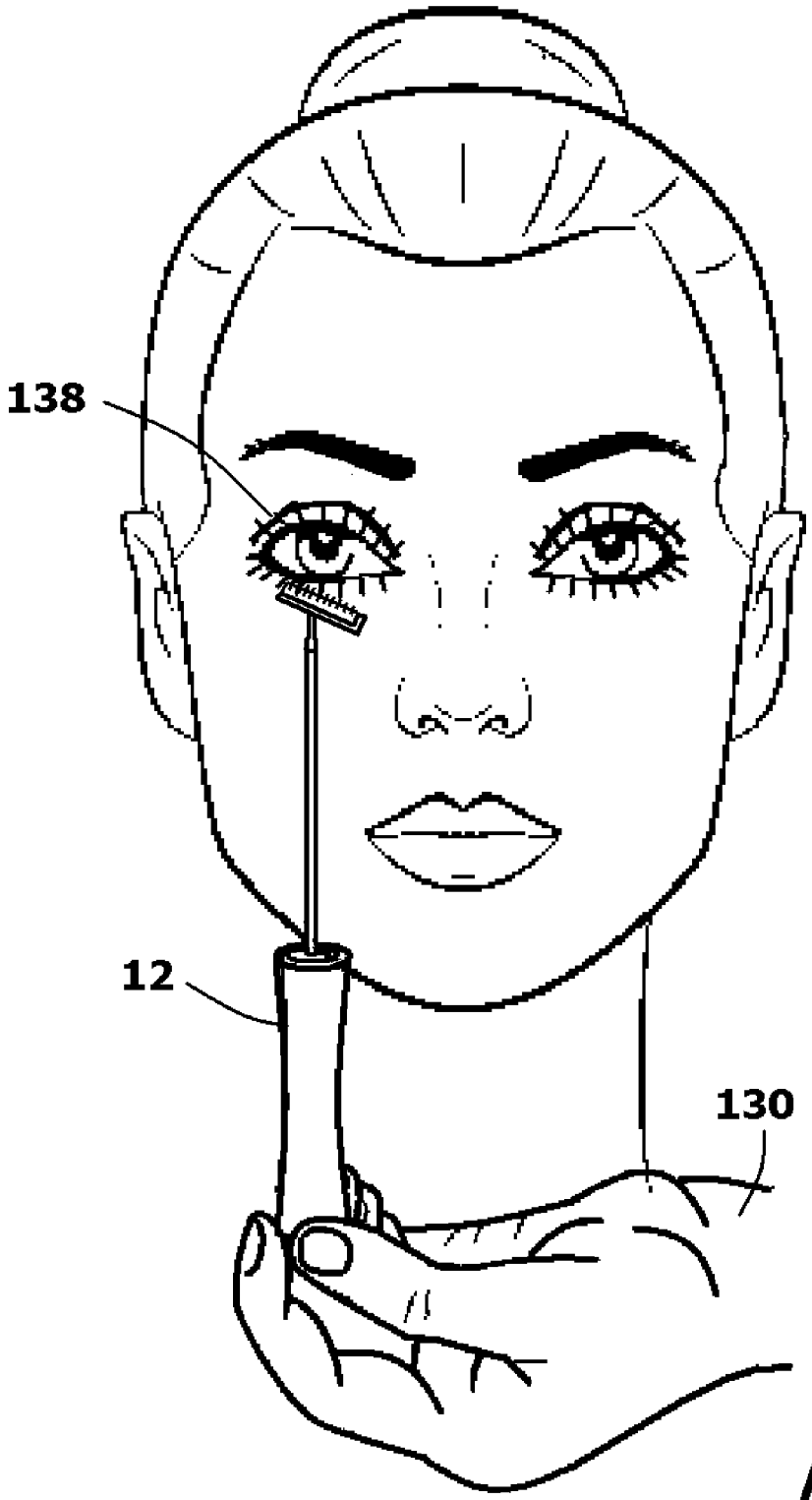
FIG. 9 shows the applicator of the exemplary embodiment in conjunction with a face and a dominant hand, wherein mascara is being applied to a second eye.

Referring to FIG. 9, it can be seen that when a person uses the applicator wand 12 on the second eye 138 farthest from the dominant hand 130, the angle at which the applicator wand 12 is held changes very slightly. The dominant hand 130 can therefore apply mascara 16 to the second eye 138 with the same precision as used on the dominant side first eye 132. Accordingly, a person can have a clear view of a mirror with his/her dominant side first eye 132 while mascara 16 is being applied to the non-dominant side second eye 138.

It will therefore be understood that the mascara application system 10 enables a person to effectively apply mascara 16 to both eyes 132, 138 while holding the applicator wand 12 in only the dominant hand 130. Since a person has more precise motor skills when using his/her dominant hand 130, the mascara 16 can be applied with more accuracy and precision. Furthermore, the quality of the application will be consistent across both eyes.

The embodiments of the present invention that are illustrated and described are merely exemplary and a person skilled in the art can make many variations to those embodiments. For instance, the length, width and shape of both the cap and the container can be changed to accommodate different volumes of mascara. Likewise, the conical shape of the brush can be changed to a cylindrical shape or a conical shape with a greater or lesser converging angle. All such embodiments are intended to be included within the scope of the present invention as defined by the appended claims.

What is claimed is:

1. A system for the application of mascara, comprising:
a handle having a central axis;
a brush having a first end and an opposite second end, wherein said brush has bristles that are disposed about a center line;
a wand shaft that extends from said handle;
an articulable mount having an arm, a support bracket, and a hinge joint that interconnects said arm to said support bracket, wherein said arm connects to said wand shaft and said support bracket supports said brush, and wherein said articulable mount orients said brush in a position where said central axis of said handle intersects said center line of said brush at a point between said first end and said second end of said brush.

2. The system according to claim 1, wherein said center line of said brush is biased in a first angle of inclination relative to said central axis by said articulable mount.

3. The system according to claim 2, wherein said hinge joint enables said brush to temporarily rotate about said hinge joint away from said first angle of inclination.

4. The system according to claim 3, wherein said hinge joint enables said brush to rotate to a second angle of inclination where said center line of said brush is parallel to said central axis of said handle.

5. The system according to claim 4, wherein said arm contains a relief that can receive a portion of said support bracket when said brush is oriented in said second angle of inclination.

6. The system according to claim 4, further including a container that is accessible through a narrowed neck, wherein said narrowed neck has an inside diameter.

7. The system according to claim 6, where said brush can pass through said narrowed neck in said second angle inclination and cannot pass through said narrowed neck in said first angle of inclination.

8. The system according to claim 6, further including a tapered structure in said container that contacts and moves said brush from said first angle of inclination to said second angle of inclination as said brush is drawn out of said container through said narrowed neck.

9. The system according to claim 6, wherein said container includes a tapered structure that contacts and moves said brush from said first angle of inclination to said second angle of inclination as said brush is drawn out of said container by said handle and said wand shaft.

10. The system according to claim 1, wherein said arm, said support bracket and said hinge joint are a unistructurally molded unit.

11. A system for the application of mascara, comprising:
a handle having a central axis;
a brush having a first end and an opposite second end, wherein said brush has bristles that are disposed about a center line;
a wand shaft that extends from said handle;
an articulable mount that contains an arm, a support bracket, and a hinge joint wherein said arm connects to said wand shaft, said support bracket supports said brush, and said hinge joint interconnects said arm to said support bracket, wherein said articulable mount biases said brush in a position where said center line of said brush is at a first angle of inclination relative to said central axis of said handle;
a container having an access opening, wherein said brush cannot pass through said access opening in said first angle of inclination, and wherein said articulable mount automatically deflects said brush into a second angle of inclination that can pass through said access opening when said brush is moved into said access opening.

12. The system according to claim 11, wherein said central axis of said handle intersects said center line of said brush at a point between said first end and said second end of said brush.

13. The system according to claim 12, wherein said second angle of inclination orients said center line of said brush in parallel to said central axis of said handle.

14. The system according to claim 11, wherein said arm contains a relief that can receive a portion of said support bracket when said brush is oriented in said second angle of inclination.

15. The system according to claim 14, further including a tapered structure in said container that contacts and moves said brush from said first angle of inclination to said second angle of inclination as said brush is drawn out of said container.

16. The system according to claim 14, wherein said container includes a tapered structure that contacts and moves said brush from said first angle of inclination to said second angle of inclination as said brush is drawn out of said container by said handle and said wand shaft.

* * * * *